United States Patent [19]

Satz

[11] 4,009,573

[45] Mar. 1, 1977

[54] ROTARY HOT GAS REGENERATIVE ENGINE

[75] Inventor: Ronald W. Satz, 4518 Cedar Lake Road, St. Louis Park, Minn. 55416

[73] Assignee: Transpower Corporation, St. Louis Park, Minn.

[22] Filed: Dec. 2, 1974

[21] Appl. No.: 528,703

[52] U.S. Cl. ..... 60/519; 60/526; 418/7; 418/8; 418/13

[51] Int. Cl.[2] ..... F02G 1/04

[58] Field of Search ..... 60/516–526, 60/650, 682, 39.45, 39.61; 123/8.23; 418/13, 7, 8

[56] References Cited

UNITED STATES PATENTS

| | | | |
|---|---|---|---|
| 1,457,696 | 6/1923 | Ford | 418/13 |
| 2,480,525 | 8/1949 | Van Weenen | 60/525 |
| 2,907,169 | 10/1959 | Newton | 60/526 |
| 3,169,375 | 2/1965 | Velthuis | 60/670 |
| 3,426,525 | 2/1969 | Rubin | 60/519 |
| 3,744,245 | 7/1973 | Kelly | 60/519 |
| 3,807,176 | 4/1974 | Hakannsson | 60/525 |
| 3,867,815 | 2/1975 | Barrett | 60/690 X |
| 3,904,327 | 9/1975 | Edwards et al. | 418/13 X |

FOREIGN PATENTS OR APPLICATIONS

| | | | |
|---|---|---|---|
| 622,176 | 1961 | Italy | 418/8 |

*Primary Examiner*—Allen M. Ostrager
*Attorney, Agent, or Firm*—Morse, Altman, Oates & Bello

[57] ABSTRACT

A rotary positive displacement, hot gas regenerative engine having at least two cylindrical rotors, each of which is disposed within an elliptical stator. The longitudinal axis of one rotor is in registration with the longitudinal axis of the other rotor. The longitudinal axis of one stator is offset from and is in spaced parallel relationship with the longitudinal axis of the other stator. The longitudinal axes of the rotors are in spaced parallel relationship with the longitudinal axes of the stators. The rotors, which are mounted on a common shaft, are provided with a plurality of radially extending slidable vanes that form a plurality of expansion chambers and a plurality of compression chambers in each rotor-stator pair. The longitudinal axis of the rotor in each rotor-stator pair is offset from the longitudinal axis of the stator of that rotor-stator pair so that the volume of the expansion chambers is greater than the volume of the compression chambers. The stators are interconnected by ducts in such a manner that a compressed fluid in the compression chamber of one rotor-stator pair is directed to the expansion chamber of the other rotor-stator pair and the compressed fluid in the compression chamber of the latter rotor-stator pair is directed to the expansion chamber of the former rotor-stator pair. Compressed fluid flowing from the compression chambers is directed successively through a rotary regenerator and heater before entering the expansion chambers, and expanded fluid exiting from the expansion chambers is directed through the rotary regenerator. The rotary regenerator operates alternately as an energy storer and as an energy releaser for each of the rotor-stator pairs.

15 Claims, 7 Drawing Figures

ROTARY HOT GAS REGENERATIVE ENGINE

BACKGROUND OF THE INVENTION

1. Field of the Invention

The present invention relates generally to heat and combustion engines, and, more particularly, is directed towards a rotary positive displacement hot gas regenerative engine.

2. Description of the Prior Art

Engines with fluid working media may be classified as heat engines or combustion engines. Heat engines include the Rankine, the Stirling, and the Ericsson engines. Here the combustion or heating is external to the engine. Combustion engines, such as the Otto, the Brayton, and the Diesel engines have combustion taking place in the working medium itself. The new engine may be used as either a heat engine (with open or closed cycle) or as a combustion engine (with open cycle). As a heat engine, it would follow the regenerative Brayton cycle or the Ericsson cycle; as a combustion engine, it would follow the regenerative Brayton cycle. The advantages of the present engine over its predecessors are discussed later.

SUMMARY OF THE INVENTION

It is an object of the present invention to provide a rotary, positive displacement, hot gas regenerative engine operative on either an open or closed cycle, heating of the gas being internal or external. The engine comprises at least two cylindrical rotors, each of which is disposed within an elliptical stator. The longitudinal axis of one rotor is in registration with the longitudinal axis of the other rotor. The longitudinal axis of one stator is offset from and is in spaced parallel relationship with the longitudinal axis of the other stator. The longitudinal axes of the rotors are in spaced parallel relationship with the longitudinal axes of the stators. The major axes of the stators are in spaced parallel relationship to one another and are in perpendicular relationship with respect to the longitudinal axes of the rotors. The rotors, which rotate on a common shaft, are provided with a plurality of radially extending slidable vanes that form a plurality of expansion chambers and a plurality of compression chambers in each rotor-stator pair, the expansion chambers and the compression chambers being disposed on opposite sides of the stators. The longitudinal axis of the rotor is offset from the axis of its associated stator so that the volume of the expansion chambers is greater than the volume of the compression chambers. The elements of the engine are defined as (1) energy transducers, (2) energy sources, (3) energy sinks, (4) energy transmitters, (5) energy storers, (6) energy modulators, and (7) energy dissipators. In the compression process, mechanical energy is transduced into fluid energy; in the expansion process, fluid energy is transduced into mechanical energy. Combustors or burners and heating tubes, operate as energy sources for the working fluid. Coolers and the atmosphere itself operate as energy sinks for the working fluid. Each stator has four ports, inlet and outlet ports for the compression side and inlet and outlet ports for the expansion side. The outlet port on the compression side of one stator is connected by a duct to the inlet port of the expansion side of the other stator. In the closed cycle version, the outlet port of the expansion side of one stator is connected by a duct to the inlet port of the compression side of the other stator. These ducts define energy transmitters. As the working fluid travels from the compression side of one stator to the expansion side of the other stator, it passes through energy sources and as the working fluid travels from the expansion side of one stator to the compression side of the other stator it passes through energy sinks. A rotary regenerator, which alternately serves as an energy storer and as an energy releaser, is disposed between the stators. As the expanded gas flows through the rotary regenerator, it gives up most of its remaining heat to the compressed gas, thereby increasing engine efficiency. In the open cycle version, engine output is controlled by a throttle in the line to the compression side of the stators; in the closed cycle version, a system of pumps and accumulators controls the amount of mass of working fluid within the engine; both the open and closed cycle versions are also controllable by variable port openings for changing engine pressure ratio. In the open cycle version, engine starting is by the conventional alternator-battery-starting motor combination; in the closed cycle version, the engine is started by letting in compressed gas from the accumulator. The control system and starting system elements define energy modulators. Finally, both mechanical and fluid friction, which decrease the net shaft work of the engine, define energy dissipators.

It is another object of the present invention to provide a rotary, positive displacement, hot gas regenerative engine wherein a cool working fluid, for example, air in the open cycle version, and helium or hydrogen in the closed cycle version, enters the inlet port of one of the stators and is compressed between the vanes, stator, and rotor, as the rotor turns. Depending on the amount of cooling, the compression is adiabatic, polytropic, or isothermal. Cooling is accomplished by running a coolant, such as water, through channels formed in the stator sidewall or by injecting coolant into the working fluid. Then, the gas leaves the one stator through the compression outlet port, transfers through a duct to the rotary regenerator. The rotary regenerator, which is exposed alternately to hot and cold streams of gas, stores and releases heat. After regeneration, the gas is heated further in the heater tubes. In an internal combustion embodiment, the fuel is directly mixed with the working fluid, and combustion takes place at constant pressure; no spark ignition or compression ignition is involved. In an external combustion embodiment, the gas passes through heater tubes, which are heated by combustion flames either directly or indirectly by means of a heat pipe, an isothermal energy transmitter. If heat pipes are used, only one burner is necessary for the entire engine. After heating, the gas enters the expansion chambers of the other stator. Depending on the amount of heating, the expansion takes place adiabatically, polytropically or isothermally. Heating of the gas during expansion is accomplished by means of heat pipes formed in the stator sidewall. During expansion, work is done by the gas on the vanes and thus the rotor, thereby producing shaft power. The expanded gas, which is still relatively hot, leaves the other stator, transfers through a duct to the rotary regenerator, and gives up most of its remaining heat to the material of the regenerator, for example, a fine mesh of metal or ceramic wire. This heat is transferred by means of the rotation of the regenerator to the compressed gas, and thus is not wasted. After regeneration, the expanded gas is exhausted from the engine to the atmosphere in the open cycle version. In the closed cycle version, the gas passes through a counterflow heat exchanger, where it gives up its remaining heat to the coolant. Then, the gas proceeds to the inlet port of the one stator and the cycle repeats.

The invention accordingly comprises the system possessing the construction, combination of elements, and arrangement of parts that are exemplified in the following detailed disclosure, the scope of which will be indicated in the claims.

BRIEF DESCRIPTION OF THE DRAWINGS

For a fuller understanding of the nature and objects of the present invention, reference is made to the following detailed description, taken in connection with the accompanying drawings, wherein.

DETAILED DESCRIPTION OF THE PREFERRED EMBODIMENTS

Figure 1:
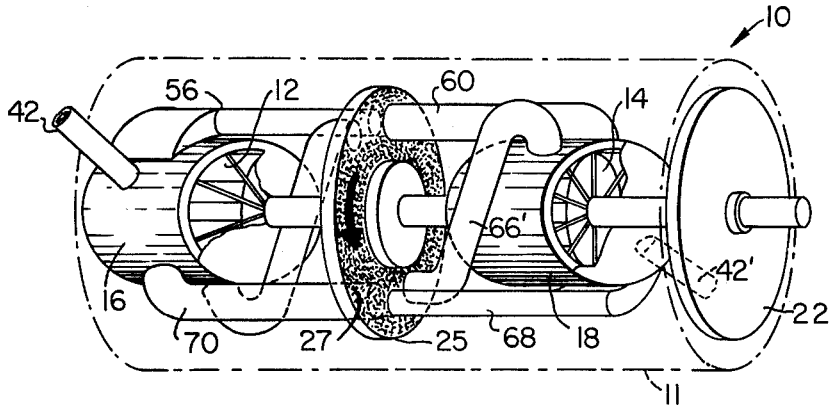
FIG. 1 is a perspective view of a rotary hot gas regenerative device embodying the present invention.
Figure 2:
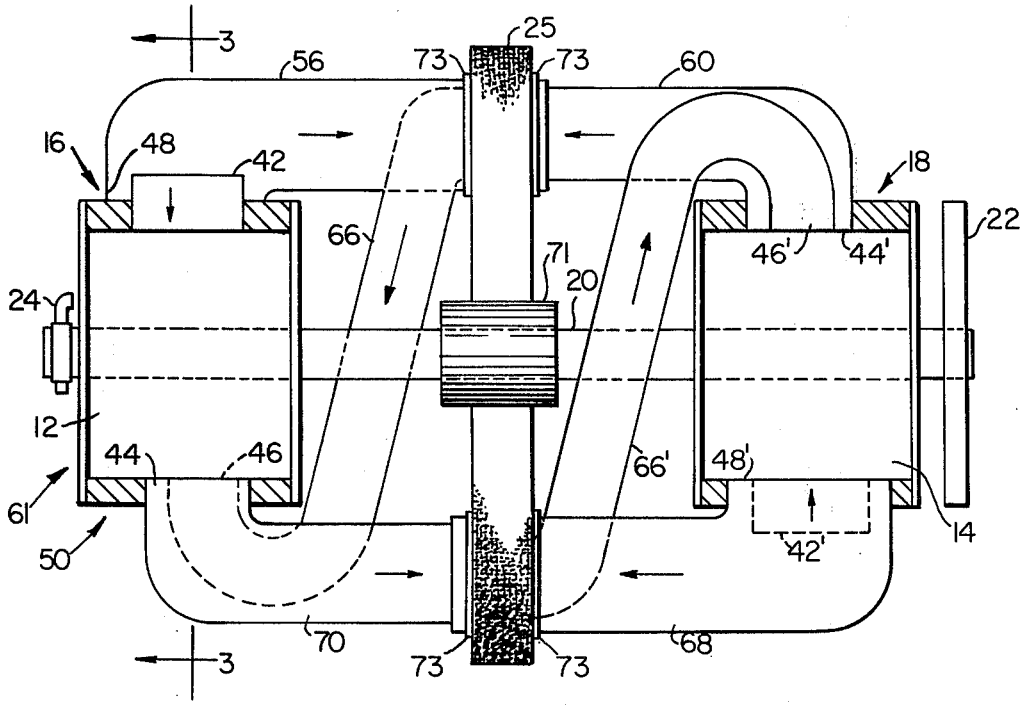
FIG. 2 is a side elevation of the rotary hot gas regenerative device of FIG. 1.

Referring now to the drawings, particularly FIGS. 1 and 2, there is shown an open cycle version of a rotary, positive displacement, hot gas regenerative device 10 embodying the present invention that is operative on an open or closed cycle. In the illustrated embodiment, hot gas regenerative device 10 is in the form of an engine comprising a housing 11, elliptical stators 16, 18 and cylindrical rotors 12, 14. Cylindrical rotors 12 and 14 are disposed within elliptical stators 16 and 18, respectively. The longitudinal axis of rotor 12 is in registration with the longitudinal axis of rotor 14. The longitudinal axis of stator 16 is offset from and is in spaced parallel relationship with the longitudinal axis of stator 18. The common longitudinal axis of rotors 12, 14 is in spaced parallel relationship with the longitudinal axis of each stator. The major axes of stators 16, 18 are in spaced parallel relationship to one another and are in perpendicular relationship with respect to the longitudinal axes of the rotors. Rotors 12 and 14, which are closed at their outer ends and opened at their inner ends, are mounted on a common shaft 20 that extends through stators 16 and 18. The shaft is mounted in bearings connected to the housing. A flywheel 22 and a counterweight 24 are mounted to shaft 20 adjacent the outer faces of stators 18 and 16, respectively. A rotary regenerator 25, which includes a fine mesh of metal or ceramic wire portion 27, is mounted medially between the inner faces of stators 16 and 18. In the illustrated embodiment, by way of example, there are shown two elliptical stators, each stator having a cylindrical rotor disposed therein, the axis of the rotors being offset from the axes of the stators. In alternative embodiments, the number of stators and rotors is other than two, for example four, six or any multiple of two.

Figure 3:
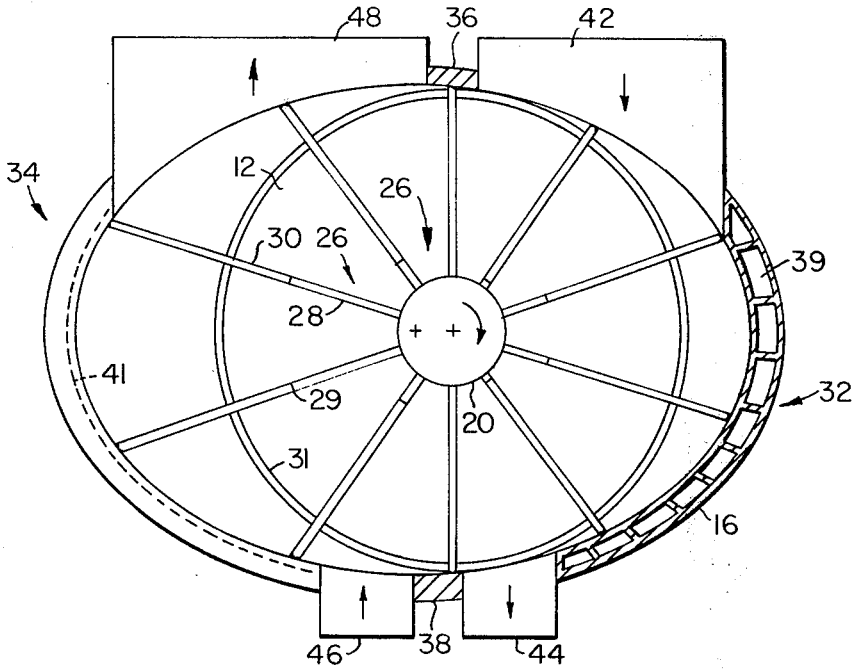
FIG. 3 is a cross-sectional view taken along the lines 3—3 of FIG. 2.

Referring now to FIG. 3, there is shown details of stator 16 and rotor 12. Although the details of stator 18 and rotor 14 are not shown, it is to be understood that the structure and function of stator 16 and rotor 12 are similar to the structure and function of stator 18 and rotor 14. Rotor 12 has a circular profile in right cross-section, the diameter of which is slightly less than the length of the minor axis of stator 16. Rotor 12 is formed with a plurality of equally spaced rectangular slots 26, each slot adapted to receive a sleeve 28. A radially extending vane 30 is slidably received in each sleeve 28, the outer edges of each vane engaging the inner surface of stator 16. Each vane 30 is in its most extended position when disposed in registration with the major axis of stator 16 and in its most retracted position when disposed in registration with the minor axis of stator 16. In the illustrated embodiment, by way of example, rotor 12 is provided with ten vanes 30. In alternative embodiments, the number of vanes is other than ten, for example the number of vanes is between six and thirty. For high power versions of engine 10, i.e. very high pressures, the outer end of each rotor is formed with grooves for supporting the vanes. In such a version, the vanes are provided with straight seals 29 and the rotors are provided with a circular seal ring 31.

Stator 16, which has an elliptical profile in right cross-section, is divided into a compression section 32 and an expansion section 34, insulators 36 and 38 being disposed between the two sections about the minor axis of stator 16. Compression section 32 is formed with a plurality of arcuately disposed channels 39 through which a coolant flows, each channel being in spaced parallel relationship with the axis of shaft 20. Compression section 32 is composed of a metal that is characterized by good thermal conduction and light weight, preferably an aluminum-magnesium alloy. Expansion section 34 is composed of a metal that is characterized by very high temperature resistance, preferably stainless steel, which is operative as a heat sink for a heat pipe 41. In the internal combustion embodiment, the expansion section is provided with coolant channels, in the same manner as the compression section. In this way, boundary layer cooling is achieved for protection of the metal.

As best shown in FIG. 3, vanes 30 are operative to form a plurality of variable volume chambers 40 between rotor 12 and stator 16. It will be readily appreciated that the volume of each chamber 40 varies as rotor 12 rotates with shaft 20, the ends of vanes 30 engaging the inner surface of stator 16. The axis of rotor 12 is offset from the axis of stator 16 in such a manner that the volume of the chambers formed at expansion section 34 is greater than the volume of the chamber formed at compression section 32 so that a thermodynamic cycle may be followed. Stator 16 is provided with inlet port 42 and an outlet port 44 for compression section 32, and an inlet port 46 and an outlet port 48 for expansion section 34. Cool working fluid enters compression inlet port 42, is cooled and compressed, and then exits outlet port 44. Hot working fluid enters expansion inlet port 46, is heated and expanded, and then exits expansion outlet port 48. For convenience, corresponding elements of rotor 12, stator 16, and rotor 14, stator 18 are denoted by like reference characters and distinguished by a prime notation. An endplate and a gasket, generally shown at 50, seal the outer end of rotor 12.

As best shown in FIG. 2, expanded gas as at expansion outlet port 48 of stator 16 enters a duct 56 which is composed of a ceramic or cermet. The compressed gas at compression outlet port 44 of stator 18 enters a duct 60, which is composed of an aluminum magnesium alloy. The expanded gas at expansion outlet port 48 of stator 18 enters a duct 68 which is composed of a ceramic or cermet. The compressed gas at compression outlet port 44 of stator 16 enters a duct 70, which is composed of an aluminum magnesium alloy. Heater tubes 66, composed of a metal such as stainless steel, are shown without the heat pipes or burner. Rotary regenerator 25 rotates at about 10 rpm against stationary seals 73. In the illustrated open cycle version, device 10 is provided with an air filter and silencer, which are located at the compression side intake of each stator. For small pressure drop and leakage, rotary regenerator 25 is made very thin and is driven by means of a gear reduction unit, exhaust gases, or by electricity supplied by the alternator, (not shown). In addition, in a closed cycle version (not shown), the engine has a counterflow cooler, composed of a metal such as copper, and located in the path of the gas exiting the expansion chamber.

In the external combustion version, a battery-operated, combined electric motor-generator drives a fuel air pump and blower which cause fuel and air to be blown to the burner. An atomizer, together with a capacitor discharge ignition, ignites the mixture, and after about 15 seconds the heater reaches working temperature (kept constant by a thermostat). These components are not shown. In the open cycle version, a normal starting motor starts the engine; in the closed cycle version, compressed gas from the accumulator starts the engine. The blower (for the external combustion version) is connected to drive shaft 20 by a variable V-belt which gives the blower a speed proportional to that of the engine. A constant amount of excess air is supplied so as to promote complete burning. Some exhaust gas is recirculated to comply with pollution standards. The external combustion version employs a rotary preheater. As the exhaust gases pass out, they give up their heat to the incoming cool air. Like the main rotary regenerator, the preheater may be driven by means of a gear reduction unit, by the exhaust gases themselves, or electrically.

Shaft 20 is sealed by means of face seals 61 having wedge packing composed of a plastic such as a tetrafluoroethelyne polymer. Because of low pressures, low pressure ratios, and a large number of vanes 30, for lower power versions, leakage around the vanes is negligible. For low power versions, the tips of the vanes are urged into contact with the stator wall due to centrifugal force. For high power versions, special seals of the type previously described are used. Also, for high power versions, mechanical or pneumatic means are provided to keep the tips of vanes in contact with the stator wall. Preferably, the entire inside walls of stators 16, 18, the outer surfaces of rotors 12, 14, slots 26, and vanes 30 are coated with a solid lubricant, such as calcium fluoride. In addition to this boundary lubrication, hydrodynamic lubrication is provided by proper curvature of the vane tips. For extreme cases, liquid lubricant is injected into the working fluid.

Operation

In the open cycle version of engine 10, illustrated in FIGS. 1, 2 and 3, a cool working fluid, for example air, first enters inlet port 42 of stator 16 and is compressed in chambers 40 in compression section 32 as rotor 12 turns. Depending on the amount of cooling, the compression is adiabatic, polytropic, or isothermal. Cooling is accomplished by running a coolant, such as water, through channels 39 formed in the sidewall of stator 16 or by injecting coolant into the working fluid. Next, the gas leaves stator 16 through compression outlet port 44 and is directed through duct 70 to rotary regenerator 25. Rotary regenerator 25, which is exposed alternately to hot and cold streams of gas, stores and releases heat. After regeneration, the gas is heated further in heater tubes 66, which are heated by combustion flames either directly or indirectly by means of a heat pipe (not shown). Next, the heated gas enters the expansion chambers of stator 18 through inlet port 46'. Depending on the amount of heating, the expansion takes place adiabatically, polytropically or isothermally. Heating of the gas during expansion is accomplished by means of heat pipes 41 provided in the sidewall of stator 18. During expansion, work is done by the gas on vanes 30 and thus the rotor 14, thereby producing shaft power. The expanded gas, which is still relatively hot, leaves stator 18, transfers through duct 68 to rotary regenerator 25, and gives up most of its remaining heat to the material of the regenerator, for example, a fine mesh of metal or ceramic wire. This heat is transferred by means of the rotation of the regenerator to the compressed gas exiting from compression outlet port 44 of stator 16, and thus is not wasted. After regeneration, the expanded gas is exhausted from engine 10 to the atmosphere in the open cycle version. In the closed cycle version, not shown, the hot gas passes through a counterflow heat exchanger and gives up its remaining heat to the coolant. Finally, the gas proceeds to compression inlet port 42 of stator 16 and the cycle repeats.

In a like manner, cool working fluid enters the compression section of stator 18 through inlet port 42' and is compressed. The compressed gas exiting compression outlet port 44' is directed through duct 60 to rotary regenerator 25. The heat stored in the material of rotary regenerator 25 from the hot gas stream leaving stator 16 is transferred to the compressed gas exiting compression outlet port 44'. After regeneration, the gas is heated further in heater tubes 66. Next, the heated gas enters the expansion chambers of stator 16 through inlet port 46. Heating of the gas during expansion is accomplished by means of heat pipes 41 provided in the sidewall of stator 16. During expansion, work is done by the gas on vanes 30 and thus rotor 12, thereby producing shaft power. The expanded gas which is still relatively hot, leaves stator 16, transfers through duct 56 to rotary regenerator 25, and gives up most of its heat to the material of the rotary regenerator. This heat is transferred to the compressed gas leaving compression outlet port 44' of stator 18 and thus is not wasted. After regeneration, the expanded gas is exhausted from engine 10 to the atmosphere in the open cycle version. In the closed cycle version, not shown, the hot gas passes through a counterflow heat exchanger and gives up its remaining heat to the coolant. Finally, the gas proceeds to compression inlet port 42' of stator 18 and the cycle repeats.

Scientific Principles

A mathematical model of the engine is now discussed, taking into account fluid and mechanical irreversibilities, variable specific heats, regenerator effectiveness, and pressure drops and leakages of the components.

A. Thermodynamics

The control volume method of analysis is used, wherein the heat and work input or output of each component is determined. In steady state operation, the amount of mass in any component remains constant with time.

1. compression process

Let $W_c$ = compression work (negative)

$m_c$ = mass of working fluid per volume cell between vanes $T_l$ = inlet temperature R = specific gas constant $r_c$ = compression volume ratio $\eta_c$ = compression efficiency, defined as the ratio of reversible work to irreversible work $n_c$ = compression polytropic coefficient (for a reversible thermodynamic process); $pV^n$ = const $\bar{c}_v$ = means specific heat at constant volume during the compression $Q_{c_W}$ = heat rejected to wall during compression $\bar{\gamma}$ = ratio of specific heats Then it can be shown that $$\frac{W_c}{m_c} = \frac{n_c R T_1}{\eta_c(1-n_c)} \left[ (r_c)^{n_c-1} - 1 \right]$$

If the compression is adiabatic, then $n_c$ is equal to the ratio of specific heats of the gas. If the compression is isothermal, the expression is $$\frac{W_c}{m_c} = \frac{RT_1}{\eta_c} \ln r_c$$

Fluid friction changes the temperature from that which would have occurred had the process been reversible. At the end of a general polytropic compression, the temperature of the gas is $$T_2 = T_1 + \frac{1-n_c}{R}\left(\frac{W_c}{m_c}\right)$$

The heat rejected to the sidewall is $$\frac{Q_{c_w}}{m_c} = c_v\left(\frac{\bar{\gamma}-n_c}{1-n_c}\right) T_1 \left(r_c^{n_c-1} - 1\right)$$

2. regeneration process

After perfect regeneration, the temperature of the compressed gas ($T_a$) would be the same as the temperature of the gas at the end of expansion ($T_4$). A regenerator effectiveness $\eta_r$ may be defined as the ratio of the actual heat transfer to the maximum possible that would occur in a perfect regenerator. Also, even in very well designed rotary regenerators some mass leakage will occur (from the high pressure side to the low pressure side). A leakage efficiency may be defined as $\eta_l = m_e/m_c$, where $m_e$ is the mass per volume cell in the expansion side. This leakage efficiency may also be considered to take into account pressure drops in the ducts, regenerator, and heater. The temperature at the end of regeneration is (very nearly)

$$T_a = \frac{\eta_r(\eta_l T_4 T_2) + T_2}{\eta_l}$$

3. heating process

Let $Q_{A_{H.T.}}$ = heat supplied to the heating tubes $h_3$ = enthalpy of the working fluid at the end of the process if all of the energy stored in the fuel had been transmitted to the working fluid $h_3$ = actual enthalpy of the working fluid at the end of the process $\eta_b$ = burner-preheater-heat pipe efficiency Then $$Q_{A_{H.T.}} = h_3' - h_a = \frac{h_3 - h_a}{\eta_b}$$

$T_3$ can be determined from $h_3$ by the gas tables. Variable specific heats should be taken into account (particularly if air is the working fluid).

4. expansion process

Let $W_e$ = expansion work (positive)

$m_e$ = mass of working fluid per volume cell between vanes $T_3$ = inlet temperature to the expansion side $R$ = specific gas constant $r_e$ = expansion volume ratio $\eta_e$ = expansion efficiency, defined as the ratio of actual work done (with ireversibilities) to that which would be done with a reversible process $Q_{A_W}$ = heat added to the hot side wall Then it can be shown that $$\frac{W_e}{m_e} = \frac{n_e R T_3 \eta_e}{1-n_e}\left[\left(\frac{1}{r_e}\right)^{n_e-1} - 1\right]$$

If the expansion is adiabatic, then $n_e = \bar{\gamma}$. If the expansion is isothermal, then $$\frac{W_e}{m_e} = \eta_e R T_3 \ln r_e$$

The actual temperature reached at the end of a general polytropic expansion is $$T_4 = T_3 - \left(\frac{W_e}{m_e}\right)\left(\frac{n_e-1}{R}\right)$$

The quantity of heat added to the hot side wall is $$\frac{Q_{A_w}}{m_e} = \frac{\bar{c}_v}{\eta_b}\left(\frac{\bar{\gamma}-n_e}{1-n_e}\right) T_3 \left[\left(\frac{1}{r_v}\right)^{n_e-1} - 1\right]$$

5. regeneration

The temperature of the expanded gas after regeneration is (very nearly)

$$T_b = \eta_l T_4 - \eta_r (\eta_l T_4 - T_2)$$

6. heat rejection

Heat rejected in the cooling tubes (closed cycle) or to the atmosphere directly (open cycle) is $$\frac{Q_{R_{C.T.}}}{m_c} = h_b - h_1$$

where, again, the gas tables should be employed.

7. computation of work, efficiency, and power The net fluid work for the cycle is the sum of the work of compression and expansion minus the change in kinetic energy of the working fluid:

$$\frac{W_{net}}{m_c} = \frac{n_c R T_1}{\eta_c (1 - n_c)} \left[ (r_c)^{n_c - 1} - 1 \right] + \frac{n_e R T_3 \eta_e \eta_l}{1 - n_e} \left[ \left( \frac{1}{r_e} \right)^{n_e - 1} - 1 \right] - \Delta k$$

for the general polytropic case. The total heat added is the sum of the heat added to the heating tubes and the hot sidewall.

$$\frac{Q_{A_{TOT}}}{\eta_l m_c} = \frac{h_3 - h_a}{\eta_b} + c_v \left( \frac{\bar{\gamma} - n_e}{1 - n_e} \right) \frac{T_3}{\eta_b} \left[ \left( \frac{1}{r_e} \right)^{n_e - 1} - 1 \right]$$

Then the indicated thermal efficiency of the engine is $$\eta_{th} = \frac{W_{net}}{Q_{A_{TOT}}}$$

Each vane cell of each rotor goes through one complete cycle every revolution. Let $N$ = revolutions per minute $z$ = number of vanes per rotor $P_{fric}$ = power needed to overcome mechanical friction $P_{aux}$ = power necessary to run blower, water pump, regenerator, preheater, fan, alternator $P_{brake}$ = useful power delivered Then, for two rotors $P_{brake} = W_{net} \times N \times 2z \times$ conversion factor $- P_{fric} - P_{aux}$ and $$\eta_{brake} = \frac{P_{brake}}{\dot{Q}_{A_{TOT}}}$$

8. example

For a complete engine analysis, the design of each component would have to be known in order to determine such quantities such as $\eta_b$, $\eta_l$, $\eta_r$, etc. Here, values based on whatever experience is available will be used. An open cycle, external combustion engine suitable for use in compact and subcompact automobiles, will now be discussed.

Based on experience with present day burners, preheaters, and heat pipes, heating efficiency, $\eta_b$, is set at 0.98. Commonly, rotary regenerators in small gas turbines have an effectiveness $\eta_r$ of about 0.90; in the new engine, no fouling of the regenerator passage ways occurs and so a finer mesh is used, which provides an increase in regenerator effectiveness to at least 0.95. To limit wear on the vanes and to limit mechanical friction, based on experience with "dry" rotary vane compressors, the tip speed of the vanes is limited to about 3000rpm. The fluid velocities in the new engine have a value between that found in reciprocation piston engines and that found in gas turbines. Fluid friction and irreversibilities can usually be ignored in piston engines; however in gas turbines, the compressor and expander efficiencies $\eta_c$ and $\eta_e$ usually have a value between 0.80 and 0.98. A value in between, such as 0.96, is selected here. Overall thermal efficiency of the engine is improved by cooling the working fluid during compression and by heating the working fluid during expansion. In the analysis, the polytropic coefficients are selected so that reasonable heat transfer coefficients are obtained. In addition, the polytropic specific heats are made equal so that over or under expansion does not occur. It will be shown that using $n_c = 1.32$ and $n_e = 1.28$ leads to very reasonable heat transfer coefficients. As discussed previously, some leakage or "carry-over" may occur in the regenerator and a value of $\eta_l = 0.98$ is used (in a sense, this coefficient may also include the effect of pressure drops across the ducts, heater, and regenerator). If stainless steel is used on the hot side, the maximum temperature $T_3$ of the fluid is limited to about 1930R (higher temperatures would require much more costly alloys). The Society of Automotive Engineers has adopted standard inlet temperature and pressure conditions for comparison of performance of engines: $T_1 = 85$ F (544.67R) and $P_1 = 29.38$ in Hg (14.39 psia). Finally, the compression and expansion ratio are selected so that the network output divided by the product of the highest engine pressure and the maximum volume is greatest (or alternatively, it is selected so that the mean effective pressure divided by the highest pressure is maximized, for the given temperature range). In the present example, the optimum $r_c$ and $r_e$ are 2.25. To summarize, the following values have been ascertained:

$\eta_b = 0.98$ $\eta_c = \eta_e = 0.96$ $\eta_r = 0.95$ $\eta_l = 0.98$ $n_c = 1.32$ $n_e = 1.28$ $T_1 = 544.67$ R $P_1 = 14.39$ psia $T_3 = 1930$ R $r_c = r_e = 2.25$ These quantities are now substituted into the equations that were presented before. For the application under consideration, the intake volume is 25 in 3 and ten vanes are used (for a given size ellipse and rotor the number of vanes makes little difference). Mechanical friction, based on rotary vane compressor experience is approximately 7 hp at maximum speed. Power required for auxiliaries is approximately 10. Note that each stator has its own inlet port and that volumetric efficiency is approximately 100%. The results of the calculations at steady state, full throttle are as follows:

1. compression process $P_1 = 14.39$ psia
$T_1 = 544.67$ R $= \mathbf{302.59K}$
$V_1 = 25$ in$^3 = \mathbf{409.75}$ cc
$P_2 = 45.58$ psia
$T_2 = 766.56$ R $= \mathbf{425.87}$ K
$V_2 = 11.11$ in$^3 = \mathbf{182.11}$ cc $$\frac{W_c}{m_c} = -36{,}986.20 \frac{\text{ft-lb}_f}{\text{lb}_m}$$

$$\frac{Q_{c_w}}{m_c} = -5380.88 \frac{\text{ft-lb}_f}{\text{lb}_m}$$

2. regeneration process
$T_a = 1414.97$ $R = 786.09$K
3. heating process
$P_3 = 44.67$ psia
$T_3 = \mathbf{1930}$ R $= 1072.22$ K
$V_3 = \mathbf{27.97}$ in$_3 = 458.43$ cc $$\frac{Q_{A_{ht}}}{m_e} = 109{,}792.02 \frac{\text{ft-lb}_f}{\text{lb}_m}$$

(Note $V_3$ could have been chosen so that $p_3 = 45.58$ psia)
4. expansion process $P_4 = 14.90$ psia
$T_4 = 1448.27$ R $= 804.59$ K
$V_4 = 62.93$ in$^3 = 1031.42$ cc $$\frac{W_e}{m_e} = 91{,}770.27 \frac{\text{ft-lb}_f}{\text{lb}_m}$$

$$\frac{Q_{A_w}}{m_e} = 13{,}504.55 \frac{\text{ft-lb}_f}{\text{lb}_m}$$

5. regeneration
$T_b = 799.20$ R $= 444.00$ K
6. heat rejection $$\frac{Q_{R_{atm}}}{m_c} = 47{,}957.38 \frac{\text{ft-lb}_f}{\text{lb}_m}$$

7. computation of work, efficiency, power $$\frac{W_{net}}{m_c} = 54.24 \text{ ft- lb}_f$$

(including $\Delta K = -0.40$ ft-lb$_f$)
$\eta_{th} = 0.43$
$P_{brake} = 81.61$ hp
$\eta_{brake} = 0.36$ This compares well with the most efficient engine in operation today.

Figure 4:
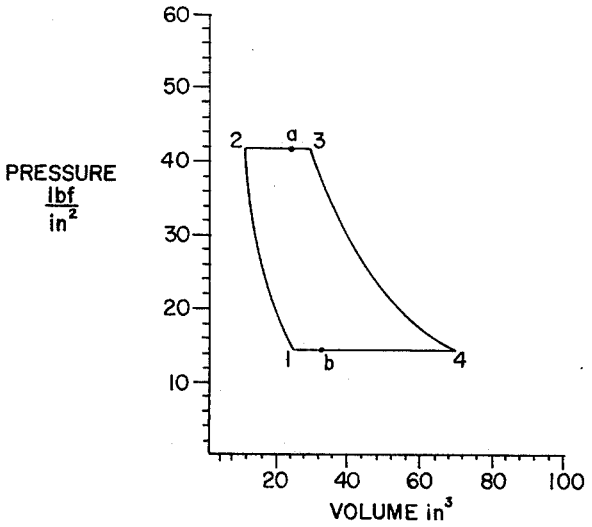
FIG. 4 is a graphical representation of pressure versus volume assuming perfect regeneration and complete expansion.
Figure 5:
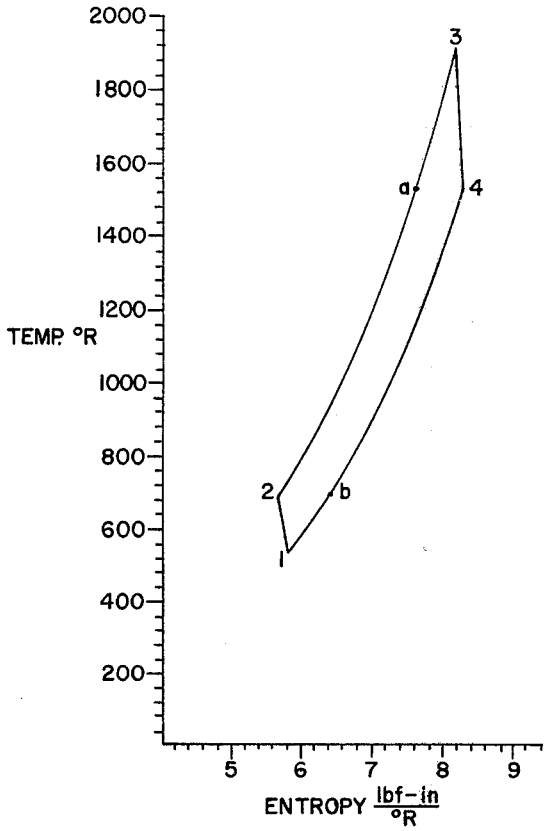
FIG. 5 is a graphical representation of temperature vs. entropy assuming perfect regeneration and complete expansion.

If the process had been perfect ($\eta_c = \eta_e = \eta_r = \eta_l = 1$, and full expansion), the $p$V and TS diagrams would be those shown in FIGS. 4 and 5 (they are drawn to the same scale).

In this case, the termal efficiency would have been well over 60% and brake power would have been about 96 hp.

B. Mechanics

Figure 6:
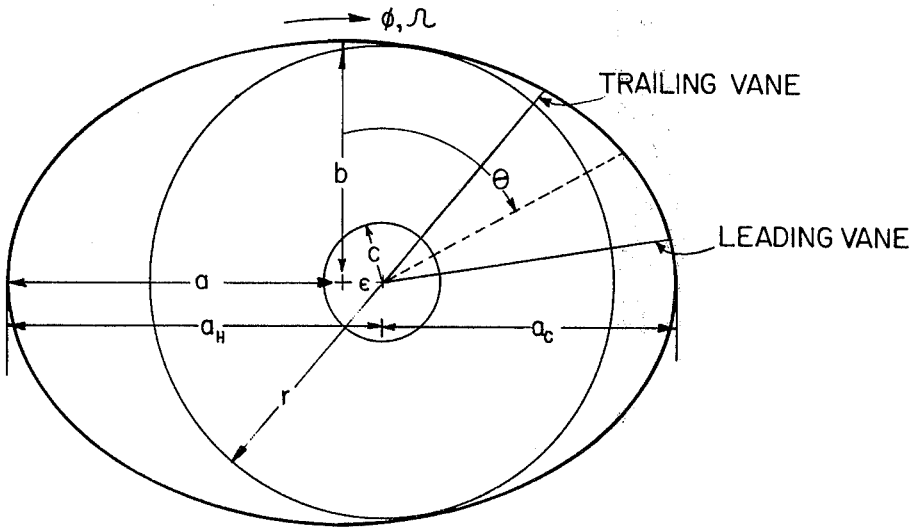
FIG. 6 is a schematic diagram illustrating the important geometrical parameters of the device of FIG. 1.

Calculations for the volume and surface area of the new engine are discussed in connection with FIG. 6. Let $V_{swept}$ = volume of gas between two adjacent vanes, the rotor and the housing, at any crankangle
$L$ = axial length of vanes and rotor
$a_c$ = major parameter of ellipse on the cold side
$a_H$ = major parameter of ellipse on hot side
$b$ = minor parameter of ellipse
$\theta$ = crankangle (angle midway between two adjacent vanes)
$\delta$ = one-half the angle between the vanes
$r$ = radius of rotor
$\epsilon$ = eccentricity Then the equation for $V_{swept}$ is closely approximated by $$V_{swept} = \frac{abL}{2}\left\{\tan^{-1}\left[\frac{b}{a}\tan(\theta+\delta)\right] - \tan^{-1}\left[\frac{b}{a}\tan(\theta-\delta)\right]\right\} - Lr^2\delta$$

where on the cold side $a_c$ is substituted for $a$, and on the hot side $a_H$ is substituted for a. In numerical work, $r$ is so close to $b$ that it may be replaced by it. Geometrically, the maximum volume on the cold side occurs at $\iota = 90°$, and the maximum volume on the hot side occurs at $\theta = 270°$. For ten vanes, $\delta = 18°$ and so $$\tan\left(\frac{\pi}{2}+\delta\right) = -3.08$$

$$\tan\left(\frac{\pi}{2}-\delta\right) = 3.08$$

In the thermal cycle described, maximum volume on the hot side is 62.93 in$^3$ and maximum volume on the cold side is 25 in$^3$. Then, $$62.93 = \frac{a_H bL}{2}\left\{\tan^{-1}\left[\frac{b}{a_H}(-3.08)\right] - \tan^{-1}\left[\frac{b}{a_H}(3.08)\right]\right\} - .314\,Lb^2$$

$$25 = \frac{a_c bL}{2}\left\{\tan^{-1}\left[\frac{b}{a_c}(-3.08)\right] - \tan^{-1}\left[\frac{b}{a_c}(3.08)\right]\right\} - .314\,Lb^2$$

To keep tip speed low, rotor radius is limited to 5 inches (12.70 cm). The radius of the crankshaft is one inch. So that 50% or more of the vane is supported at all times, the following equation must be satisfied:

$$\frac{b}{a_H} = \frac{2b}{3b-1}$$

For $b = 5$ inches, $a_H = 7$ inches (17.78 cm). Then the axial length L is found from the equation given above for the volume 62.93 in³. With L and $b$ known, $a_c$ is determined from the equation given above for 25 in³. The value of $\epsilon$, the difference between $a_H$ and $a$, or $a_c$ and $a$ (where a is major parameter of the stator) can then be calculated. Thus, for the example cited, the geometry is specified as follows:

$a_H = 7.000$ in $= 17.78$ cm
$a_c = 5.925$ in $= 15.05$ cm $b = 5.000$ in $= 12.70$ cm
$L = 8.640$ in $= 21.95$ cm
$a = 6.463$ in $= 16.42$ cm
$\epsilon = 0.538$ in $= 1.37$ cm The crankangle for the location of the exhaust port on the compression side and the inlet port on the expansion side is determined as follows:

$V_2 = 11.11$ in³

$$11.11 = \frac{La_c\, b}{2}\left\{\tan^{-1}\left[\frac{b}{a_c}\tan(\theta + .314)\right] - \tan^{-1}\left[\frac{b}{a_c}\tan(\theta - .314)\right]\right\} - Lb^2\,(.314)$$

By trial, this yields $\theta = 136°$, meaning that the port begins at $\theta + \delta = 154°$.

$V_3 = 27.97$ in³

$$27.97 = \frac{La_H\, b}{2}\left\{\tan^{-1}\left[\frac{b}{a_H}\tan(\theta + .314)\right] - \tan^{-1}\left[\frac{b}{a_H}\tan(\theta - .314)\right]\right\} - Lb^2\,(.314)$$

By trial, this yields $\theta = 230°$ and so the port ends at $\theta - \delta = 212°$. The exhaust port on the cold side may extend to almost 180°; the intake port on the hot side may begin almost at 180°. The other two ports present no problems of calculations. Note that the connecting ducts are designed for approximate constant fluid velocity through the engine.

Figure 7:
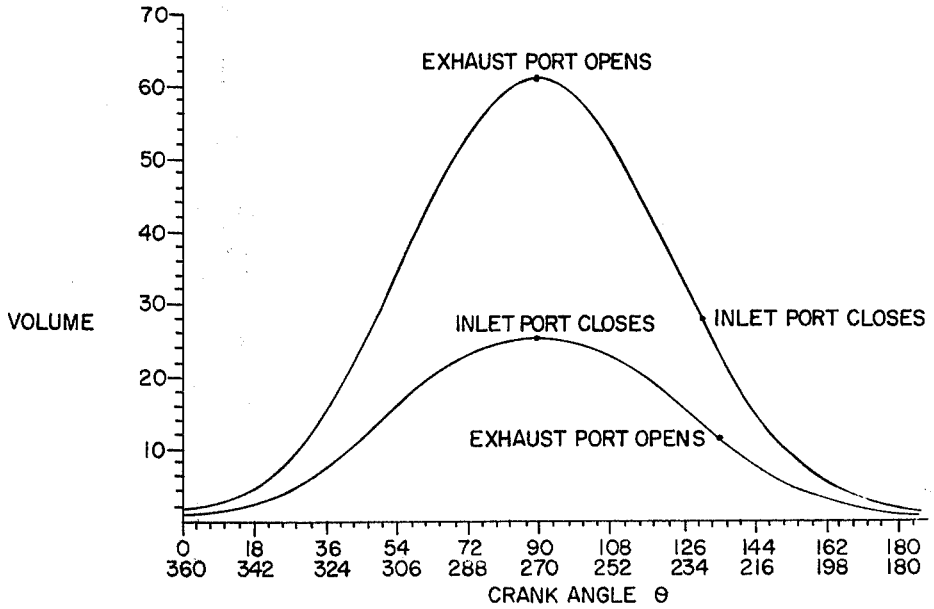
FIG. 7 is a graphical representation of swept volume vs. crankangle of the hot and cold sides of the device of FIG. 1.

FIG. 7 shows a plot of swept volume vs. crankangle for both the hot and cold sides.

With $a_H = 7$ inches, the maximum vane tip speed at 3000 rpm is 183 ft/sec. A mean fluid velocity at a = 6 inches is 157 ft/sec. Work done to accelerate stationary fluid outside the engine to this velocity is $$\Delta K = \frac{1}{2}\,\frac{m}{g}\,v^2 = .40 \text{ ft-lb}_f$$

the value that was used in the network calculations previously. For highly pressurized, closed cycle machines, a maximum rpm of less than 1000 could be used, meaning less mechanical and fluid friction and higher heat transfer coefficients.

To calculate the heat transfer coefficients, the surface areas on the hot and cold sides must be determined. Using $a_H = 7$, $a_c = 5.925$, $b = 5$, and $L = 8.640$ together with the elliptic tables (and assuming three-eighth of perimeter on each side used), the surface areas are calculated to be $A_c = 0.77$ ft²

$A_H = 0.85$ ft²

The rate at which heat is abstracted from the cold side wall is $$\dot{Q}_c = -5380.88 \times 1.032 \times 10^{-3} \times 3000\,\frac{\text{rev}}{\text{min}} \times 60\,\frac{\text{min}}{\text{hr}} \times 10\,\frac{\text{cycles}}{\text{rev}} \times 1\,\frac{\text{Btu}}{778.16 \text{ ft-lb}_f} = 12845.07\,\frac{\text{Btu}}{\text{hr}}$$

The mean temperature of the air is approximately $$\overline{T}_{air} = \frac{766.56 + 544.67}{2} = 655.62°\,R$$

The mean temperature of the cooling water (entering the channels at 85 F and leaving at 90 F) is $\overline{T}_{water} = 87.5 + 459.67 = 547.17$R Then the mean difference in temperature between the two fluid streams is $\Delta T = 655.62 - 547.17 = 108.45$ R The overall heat transfer coefficient (ignoring the small resistance of the wall and water) is $$U_c = \frac{\dot{Q}_c}{A_c\,\Delta T} = 153.82\,\frac{\text{Btu}}{\text{hr ft}^2\,R}$$

Likewise, for the hot side $$U_H = \frac{\dot{Q}_H}{A_H\,\Delta T} = \frac{31{,}597.61}{.85\,(240.87)} = 154.33\,\frac{\text{Btu}}{\text{hr ft}^2\,R}$$

These values may actually be on the low side; in fact, reciprocating piston engines often have heat transfer coefficients twice these values. For the new engine, somewhat lower polytropic coefficients could have been assumed, meaning increasing the overall efficiency by five to ten percent. Theoretically, higher heat transfer coefficients are possible because of the thin boundary layer produced by the action of the vanes.

Advantages of the Present Invention

In the range of power of power up to 5000 hp, the new engine will be competing against conventional Otto, Diesel, and Rankine positive displacement engines, the Stirling hot gas engine, and Rankine and Brayton turbines.

A. Advantages over Conventional Engines 1. higher thermal efficiency
2. lower level of pollution
3. lower noise level
4. cleaner internally
5. lighter weight due to the very low cycle pressure
6. more compact due to the large number of cycles per revolution
7. perfectly balanced
8. multi-heat source and multi-fuel capability
9. simple to manufacture, assemble and repair
10. with suitable adaptions, may serve as a cold gas engine, a heat pump, or a refrigerator B. Advantages Over the Stirling Hot Gas Engine 1. Heating in the external (or internal) combustor takes place constantly at steady pressure; the cycles in the new engine take full advantage of this with constant pressure heating of the working fluid in contrast to the Stirling cycle with its constant volume heating of working fluid.

2. The specific heat at constant pressure, $c_p$, is higher than the specific heat at constant volume, $c_v$, thereby again making the heating process in the new engine more efficient.

3. Because of constant volume regeneration, the Stirling engine works well using only hydrogen as working fluid. Other working fluids (such as helium or air) work equally well in the constant pressure processes of the new engine. And most importantly, this feature permits the new engine to run on an open cycle, thereby tremendously cutting costs: no coolers, much smaller radiator and much more simple control systems.

4. Finally, the steady flow processes of the new engine are more closely approximated with a rotary mechanism than with the intermittant flow (constant volume) processes of the Stirling cycle. Rotary mechanisms are generally smaller in size and lighter in weight than reciprocating mechanisms for the same output. The chief advantage of the rotary vane design is the very large number of cycles completed per revolution; also leakage is held to a minimum.

Advantages Over the Turbine Engine

1. When heat transfer to the hot wall or from the cold wall is attempted, higher heat transfer rates are possible in the new engine because of the thinner boundary layer created by the action of the vanes.

2. Fluid friction is lower in the new engine since fluid velocities are lower. Thus, component efficiencies are higher in the new engine. Each rotor both compresses and expands the working fluid; thus for about the same size, twice as much power is produced as would be obtained if one rotor compressed the gas and the other expanded it.

3. In the internal combustion version of the engine of the present invention, much higher temperatures are used than in the turbine. The reason for this advantage is that the arrangement is such that the vanes and rotors are alternately exposed to hot and cold gas, not to one or the other. Higher temperatures, of course, mean higher efficiencies.

Since certain changes may be made in the foregoing disclosure without departing from the scope of the invention herein involved, it is intended that all matter contained in the above description and shown in the accompanying drawings be construed in an illustrative and not in a limiting sense.

What is claimed is:

1. A hot gas engine comprising:

a. an even number of elliptical stators;

b. a plurality of cylindrical rotors equal in number to the number of said stators, one each of said rotors being disposed within and offset from the center of one each of said stators, one of said rotors and one of said stators constituting a rotor-stator pair, a longitudinal axis of said rotor of said rotor-stator pair being offset from a longitudinal axis of said stator of said rotor-stator pair;

c. a plurality of sliding vanes attached to said rotor of each said rotor-stator pair, said plurality of vanes in conjunction with the inner edge of said stator of said rotor-stator pair defining a plurality of chambers wherein compression and expansion of a fluid occur in accordance with a thermodynamic cycle, said chambers in which compression occurs define compression chambers and said chambers in which expansion occurs define expansion chambers, said compression chambers disposed at one side of said stator of each said rotor-stator pair and said expansion chambers disposed at an opposite side of said stator of each said rotor-stator pair; and d. control means for timing said thermodynamic cycle, said control means including regenerator means operatively connected between said stators of said rotor-stator pairs, said regenerator means extracting heat from said expanded fluid and imparting heat to said compressed fluid.

2. A hot gas engine comprising:

a. at least one pair of elliptical stator means, each said pair of stator means including first and second stator means, a longitudinal axis of said first stator means in spaced parallel relationship with a longitudinal axis of said second stator means;

b. at least one pair of cylindrical rotor means, each said pair of rotor means including first and second rotor means, a longitudinal axis of said first rotor means in registration with a longitudinal axis of said second rotor axis of said first rotor means in registration with a longitudinal axis of said second rotor means, said first rotor means rotatable within said first stator means, the longitudinal axis of said first rotor means offset from the longitudinal axis of said first stator means, said second rotor means rotatable within said second stator means, the longitudinal axis of said second rotor means offset from the longitudinal axis of said second stator means, the longitudinal axes of said first and second rotor means being in spaced parallel relationship with the longitudinal axis of said first stator means and the longitudinal axis of said second stator means;

c. a plurality of radially disposed slidable vanes mounted to each of said rotor means, said vanes of said first rotor means operative to engage an inner surface of said first stator means and said vanes of said second rotor operative to engage an inner surface of said second stator means, said vanes rotatable about the longitudinal axis of said rotor means associated therewith, said plurality of vanes in conjunction with the inner surface of each said stator means defining a plurality of chambers wherein compression and expansion of a working fluid occur in accordance with a thermodynamic cycle; and d. means operatively communicating with said stator means and said rotor means for controlling said thermodynamic cycle, said means for controlling including duct means and regenerator means disposed between said first and second stator means;

e. said first and second stator means including first and second inlet ports, a cool working fluid entering said compression chambers of each said first and second stator means through said first inlet port, a hot working fluid entering said expansion chambers of each said first and second stator means through said second inlet port; and f. first and second outlet ports, a compressed working fluid exiting said compression chambers of each said first and second stator means through said first outlet port, a hot expanded working fluid exiting said expansion chambers of each said first and second stator means though said second outlet port, said first inlet port and said first outlet port communicating with said compression chambers, said second inlet port and said second outlet port communicating with said expansion chambers, said first outlet port of said first stator means communicating with said second inlet port of said second stator means via said duct means, said first outlet port of said second stator means communicating with said second inlet port of said first stator means via said duct means, said regenerator means extracting heat from said expanded working fluid and imparting heat to said compressed working fluid.

3. The hot gas engine as claimed in claim 1 wherein said thermodynamic cycle is closed and said heating is external.

4. The hot gas engine as claimed in claim 1 wherein said thermodynamic cycle is open and said heating is internal.

5. A hot gas engine comprising:

a. at least one pair of elliptical stator means, each said pair of stator means including first and second stator means, a longitudinal axis of said first stator means in spaced parallel relationship with a longitudinal axis of said second stator means;

b. at least one pair of cylindrical rotor means, each said pair of rotor means including first and second rotor means, a longitudinal axis of said first rotor means in registration with a longitudinal axis of said second rotor means, said first rotor means rotatable within said first stator means, said second rotor means, said first rotor means rotatable within said first stator means, said second rotor means rotatable within said second stator means, the longitudinal axes of said first and second rotor means being in spaced parallel relationship with the lonitudinal axis of said first stator means and the longitudinal axis of said second stator means, each said first and second stator means including first and second inlet ports, a cool working fluid entering said compression chambers of each said first and second stator means through said first inlet port, a hot working fluid entering said expantion chambers of each said first and second stator means through said second inlet port, first and second outlet ports, a cool compressed working fluid exiting said compression chambers of each said first and second stator means through said first outlet port, a hot expanded working fluid exiting said expansion chambers of each said first and second stator means through said second outlet port;

c. a plurality of radially disposed slidable vanes mounted to each of said rotor means, said vanes of said first rotor means operative to engage an inner surface of said first stator means and said vanes of said second rotor operative to engage an inner surface of said second stator means, said vanes rotatable about the longitudinal axis of said rotor means associated therewith, said plurality of vanes in conjunction with the inner surface of each said stator means defining a plurality of chambers wherein compression and expansion of a working fluid occur in accordance with a thermodynamic cycle, said chambers in which compression occurs define compression chambers and said chambers in which expansion occurs define expansion chambers, said compression chambers disposed at one side of each said stator means and said expansion chambers disposed at an opposite side of each said stator means, said expansion chambers having a volume greater than the volume of said compression chambers, faces of said vanes exposed alternately to both said hot expanded working fluid and said cool compressed working fluid; and d. means operatively communicating with said stator means, and said rotor means for controlling said thermodynamic cycle, said means for controlling including duct means and regenerative means, said first inlet port and said first outlet port communicating with said compression chambers, said second inlet port and said second outlet port communicating with said expansion chambers, said first outlet port of said first stator means communicating with said second inlet port of said second stator means via said duct means, said first outlet port of said second stator means communicating with said second inlet port of said first stator means via said duct means, said regenerator means is disposed between said first and second stator means, said compressed fluid exiting said first outlet port of said first stator means directed by said duct means through said regenerator means to said second inlet port of said second stator means, said compressed fluid exiting said first outlet port of said second stator means directed by said duct means through said regenerator means to said second inlet port of said first stator means, said regenerator extracting heat from said expanded working fluid and imparting heat to said compressed working fluid.

6. The hot gas rotary engine as claimed in claim 5 wherein each said first and second stator means includes:

a. first and second inlet ports, a cool working fluid entering said compression chambers of each said first and second stator means through said first inlet port, a hot working fluid entering said expansion chambers of each said first and second stator means through said second inlet port;

b. first and second outlet ports, a compressed working fluid exiting said compression chambers of each said first and second stator means through said first outlet port, a hot expanded working fluid exiting said expansion chambers of each said first and second stator means through said second outlet port; and wherein said means for controlling includes duct means;

c. said first inlet port and said first outlet port communicating with said compression chambers, said second inlet port and said second outlet port communicating with said expansion chambers, said first outlet port of said first stator means communicating with said second inlet port of said second stator means via said duct means, said first outlet port of said second stator means communicating with said second inlet port of said first stator means via said duct means.

7. The hot gas engine as claimed in claim 6 wherein each said stator means includes heater means and cooler means, said heater means disposed adjacent said expansion chambers and said cooler means disposed adjacent said compression chambers.

8. The hot gas engine as claimed in claim 6 wherein said means for controlling includes regenerator means disposed between said first and second stator means, said compressed fluid exiting said first outlet port of said first stator means directed by said duct means through said regenerator means to said second inlet port of said second stator means, said compressed fluid exiting said first outlet port of said second stator means directed by said duct means through said regenerator means to said second inlet port of said first stator means.

9. The hot gas engine as claimed in claim 8 wherein said means for controlling includes first and second heater means, said first heater means operative to heat said working fluid passing through said regenerator means to said second inlet port of said first stator means, said second heater means operative to heat said working fluid passing through said regenerator means to said second inlet port of said second stator means.

10. The hot gas engine as claimed in claim 1 wherein said thermodynamic cycle is open and said heating is external.

11. The hot gas engine as claimed in claim 8 wherein said compression and said expansion of said fluid is adiabatic.

12. The hot gas engine as claimed in claim 8 wherein said compression and said expansion of said fluid is polytropic.

13. The hot gas engine as claimed in claim 8 wherein said compression and said expansion of said fluid is isothermal.

14. A hot gas engine comprising:

a. at least one pair of elliptical stator means, each said pair of stator means including first and second stator means, a longitudinal axis of said first stator means in spaced parallel relationship with a longitudinal axis of said second stator means;

b. at least one pair of cylindrical rotor means, each said pair of rotor means including first and second rotor means, a longitudinal axis of said first rotor means in registration with a longitudinal axis of said second rotor means, said first rotor means rotatable within said first stator means, said second rotor means rotatable within said second stator means, the longitudinal axes of said first and second rotor means being in spaced parallel relationship with the longitudinal axis of said first stator means and the longitudinal axis of said second stator means;

c. a plurality of radially disposed slidable vanes mounted to each of said rotor means, said vanes of said first rotor means operative to engage an inner surface of said first stator means and said vanes of said second rotor operative to engage an inner surface of said second stator means, said vanes rotatable about the longitudinal axis of said rotor means associated therewith, said plurality of vanes in conjunction with the inner surface of each said stator means defining a plurality of chambers wherein compression and expansion of a working fluid occur in accordance with a thermodynamic cycle, said chambers in which compression occurs define compression chambers and said chambers in which expansion occurs define expansion chambers, said compression chambers disposed at one side of each said stator means and said expansion chambers disposed at an opposite side of each said stator means, said expansion chambers having a volume greater than the volume of said compression chambers; and d. means operatively communicating with said stator means, and said rotor means for controlling said thermodynamic cycle;

e. each said first and second stator means including:

i. first and second inlet ports, a cool working fluid entering said compression chambers of each said first and second stator means through said first inlet port, a hot working fluid entering said expansion chambers of each said first and second stator means through said second inlet port;

ii. first and second outlet ports, a compressed working fluid exiting said compression chambers of each said first and second stator means through said first outlet port, a hot expanded working fluid exiting said expansion chambers of each said first and second stator means through said second outlet port; and f. said means for controlling including duct means;

g. said first inlet port and said first outlet port communicating with said compression chambers, said second inlet port and said second outlet port communicating with said expansion chambers, said first outlet port of said first stator means communicating with said second inlet port of said second stator means via said duct means, said first outlet port of said second stator means communicating with said second inlet port of said first stator means via said duct means;

h. said means for controlling includes regenerator means disposed between said first and second stator means, said compressed fluid exiting said first outlet port of said first stator means directed by said duct means through said regenerator means to said second inlet port of said second stator means, said compressed fluid exiting said first outlet port of said second stator means directed by said duct means through said regenerator means to said second inlet port of said first stator means;

i. said regenerator is a four-way rotary regenerator, said four-way regenerator extracting heat from said expanded working fluid and imparting heat to said compressed working fluid.

15. A hot gas engine comprising:

a. at least one pair of elliptical stator means, each said pair of stator means including first and second stator means, a longitudinal axis of said first stator means in spaced parallel relationship with a longitudinal axis of said second stator means;

b. at least one pair of cylindrical rotor means, each said pair of rotor means including first and second rotor means, a longitudinal axis of said first rotor means in registration with a longitudinal axis of said second rotor means, said first rotor means rotatable within said first stator means, said second rotor means rotatable within said second stator means, the longitudinal axes of said first and second rotor means being in spaced parallel relationship with the longitudinal axis of said first stator means and the longitudinal axis of said second stator means;

c. a plurality of radially disposed slidable vanes mounted to each of said rotor means, said vanes of said first rotor means operative to engage an inner surface of said first stator means and said vanes of said second rotor operative to engage an inner surface of said second stator means, said vanes rotatable about the longitudinal axis of said rotor means associated therewith, said plurality of vanes in conjunction with the inner surface of each said stator means defining a plurality of chambers wherein compression and expansion of a working fluid occur in accordance with a thermodynamic cycle, said chambers in which compression occurs define compression chambers and said chambers in which expansion occurs define expansion chambers, said compression chambers disposed at one side of each said stator means and said expansion chambers disposed at an opposite side of each said stator means, said expansion chambers having a volume greater than the volume of said compression chamber; and d. means operatively communicating with said stator means, and said rotor means for controlling said thermodynamic cycle;

e. each said first and second stator means including:

i. first and second inlet ports, a cool working fluid entering said compression chambers of each said first and second stator means through said first inlet port, a hot working fluid entering said expansion chambers of each said first and second stator means through said second inlet port;

ii. first and second outlet ports, a compressed working fluid exiting said compression chambers of each said first and second stator means through said first outlet port, a hot expanded working fluid exiting said expansion chambers of each said first and second stator means through said second outlet port; and f. said means for controlling including duct means;

g. said first inlet port and said first outlet port communicating with said compression chambers, said second inlet port and said second outlet port communicating with said expansion chambers, said first outlet port of said first stator means communicating with said second inlet port of said second stator means via said duct means, said first outlet port of said second stator means communicating with said second inlet port of said first stator means via said duct means;

h. said means for controlling includes regenerator means disposed between said first and second stator means, said compressed fluid exiting said first outlet port of said first stator means directed by said duct means through said regenerator means to said second inlet port of said second stator means, said compressed fluid exiting said first outlet port of said second stator means directed by said duct means through said regenerator means to said second inlet port of said first stator means;

i. said means for controlling includes first and second heater means, said first heater means operative to heat said working fluid passing through said regenerator means to said second inlet port of said first stator means, said second heater means operative to heat said working fluid passing through said regenerator means to said second inlet port of said second stator means;

j. said hot expanded working fluid exiting said second outlet ports of said first and second stators is directed by said duct means through said regenerator means and passes out to the atmosphere, said gas engine characterized by an open cycle.

* * * * *